US010327574B2

(12) United States Patent
Yang et al.

(10) Patent No.: US 10,327,574 B2
(45) Date of Patent: Jun. 25, 2019

(54) ANTI-LOOSE THERMAL INSULATION CUP SLEEVE WITH REVERSE DAMPING STRUCTURE

(71) Applicants: Tai-Her Yang, Dzan-Hwa (TW); Chun-Rong Yang, Dzan-Hwa (TW)

(72) Inventors: Tai-Her Yang, Dzan-Hwa (TW); Chun-Rong Yang, Dzan-Hwa (TW)

(73) Assignee: Tai-Her Yang, Dzan-Hwa (TW)

( * ) Notice: Subject to any disclaimer, the term of this patent is extended or adjusted under 35 U.S.C. 154(b) by 88 days.

(21) Appl. No.: 15/639,726

(22) Filed: Jun. 30, 2017

(65) Prior Publication Data

US 2017/0295972 A1 Oct. 19, 2017

Related U.S. Application Data

(62) Division of application No. 13/446,208, filed on Apr. 13, 2012, now Pat. No. 9,717,356.

(51) Int. Cl.
*A47G 23/02* (2006.01)

(52) U.S. Cl.
CPC ..... *A47G 23/0216* (2013.01)

(58) Field of Classification Search
CPC ..... A47G 23/0216; A47G 2023/0275; A47G 2023/0291; B65D 81/3876
USPC ..... 229/403, 405; 220/903, 739
See application file for complete search history.

(56) References Cited

U.S. PATENT DOCUMENTS

| | | | | |
|---|---|---|---|---|
| 4,207,984 | A | 6/1980 | Kelly et al. | |
| 5,203,490 | A | 4/1993 | Roe | |
| 6,286,754 | B1 | 9/2001 | Stier et al. | |
| 6,749,082 | B1 | 6/2004 | Nickel | |
| D547,653 | S | 7/2007 | Wong | |
| 7,458,504 | B2 | 12/2008 | Robertson et al. | |
| 7,717,325 | B2 * | 5/2010 | Puls | B65D 81/3869 220/592.17 |
| 8,387,857 | B2 * | 3/2013 | Messerschmid | B65D 81/3869 220/592.17 |
| 2009/0114661 | A1 | 5/2009 | Lim | |
| 2010/0147937 | A1 | 6/2010 | Reid et al. | |
| 2010/0200647 | A1 | 8/2010 | Tedford et al. | |

* cited by examiner

*Primary Examiner* — Andrew T Kirsch
*Assistant Examiner* — Don M Anderson
(74) *Attorney, Agent, or Firm* — Bacon & Thomas, PLLC

(57) ABSTRACT

The present invention provides a cup sleeve formed with a reverse damping structure having one or more rings inwardly bent and annularly arranged on one or both of the edge and the inner periphery of the cup sleeve, so when the mentioned cup sleeve is sleeved with a cup-shaped or bottle-shaped or can-shaped container, the anti-slip damping for enhancing the anti-loose function is provided by the reverse damping structure, thus the cup sleeve is less likely to be released from the cup-shaped or bottle-shaped or can-shaped container, and with the reverse damping structure, the interval formed between the cup sleeve and the cup-shaped or bottle-shaped or can-shaped container is enlarged thereby increasing the thermal insulation effect.

12 Claims, 10 Drawing Sheets

ANTI-LOOSE THERMAL INSULATION CUP SLEEVE WITH REVERSE DAMPING STRUCTURE

BACKGROUND OF THE INVENTION

(a) Field of the Invention

The present invention provides a cup sleeve formed with a reverse damping structure having one or more rings inwardly bent and annularly arranged on one or both of the edge and the inner periphery of the cup sleeve, so when the mentioned cup sleeve is sleeved with a cup-shaped or bottle-shaped or can-shaped container, the anti-slip damping for enhancing the anti-loose function is provided by the reverse damping structure, thus the cup sleeve is less likely to be released from the cup-shaped or bottle-shaped or can-shaped container, and with the reverse damping structure, the interval formed between the cup sleeve and the cup-shaped or bottle-shaped or can-shaped container is enlarged thereby increasing the thermal insulation effect.

(b) Description of the Prior Art

A conventional thermal insulation cup sleeve is usually formed in parallel or formed with a ring shape having larger caliber at the top and smaller caliber at the bottom, for being sleeved with a cup-shaped or bottle-shaped or can-shaped container; because the inner caliber of the cup sleeve has to be larger than the diameter of the cup-shaped or bottle-shaped or can-shaped container for being sleeved in, the cup sleep may be more likely to slip or fall after being sleeved with the cup-shaped or bottle-shaped or can-shaped container; if a cup sleeve made of a paper material is used to be directly in contact with the cup-shaped or bottle-shaped or can-shaped container, the provided thermal insulation effect is relatively reduced; if a cup sleeve made of a corrugated board having tubular hole layers is adopted, the thermal insulation effect is increased but still has a disadvantage of being likely to slip and fall.

SUMMARY OF THE INVENTION

The present invention provides a cup sleeve formed with a reverse damping structure having one or more rings inwardly bent and annularly arranged on one or both of the edge and the inner periphery of the cup sleeve, so when the mentioned cup sleeve is sleeved with a cup-shaped or bottle-shaped or can-shaped container, the anti-slip damping for enhancing the anti-loose function is provided by the reverse damping structure, thus the cup sleeve is less likely to be released from the cup-shaped or bottle-shaped or can-shaped container, and with the reverse damping structure, the interval formed between the cup sleeve and the cup-shaped or bottle-shaped or can-shaped container is enlarged thereby increasing the thermal insulation effect.

The mentioned reverse damping structure includes at least one or both of the edge and the interior of the cup sleeve being formed with one or more than one of a wrinkling damping structure or tooth damping structure or wavelike damping structure or trapezoid damping structure, which are formed with one or more rings annularly-arranged and downwardly and reversely bent relative to the sleeve-in direction.

DESCRIPTION OF MAIN COMPONENT SYMBOLS

Figure 1:
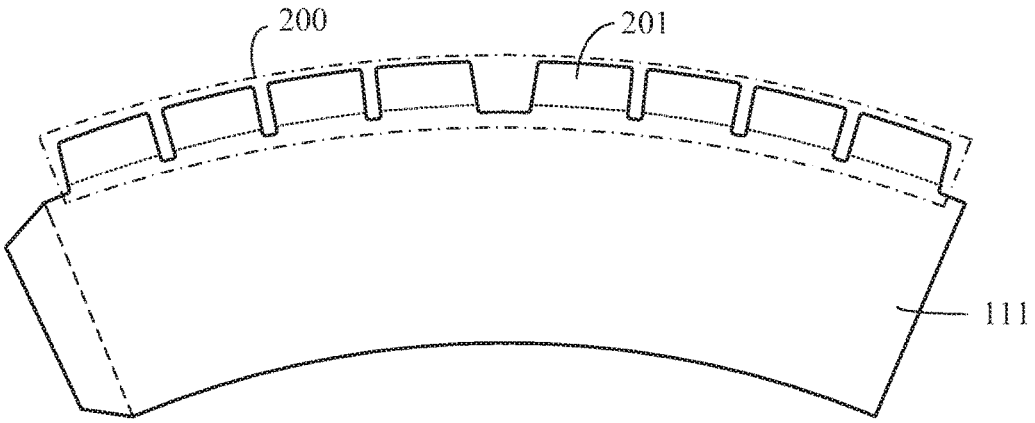
FIG. 1 is a schematic expanded view showing the edge inward bending sheet (201) being adopted for composing the reverse damping system (200) of the cup sleeve with reverse damping structure (111), according to the present invention.

100: container
101: open side
102: seal side
111: cup sleeve with reverse damping structure
200: reverse damping structure
201: edge inward bending sheet
202: edge inward wrinkling member
203: edge inward bending wavelike tooth sheet
204: edge inward bending trapezoid sheet
205: inner periphery inward bending sheet
206, 207: individual circular structure having inward bending sheet
208, 209: inward bending sheet clamped at the periphery of edge frame
211: pre-force arm
218, 219: edge inward bending sheet of integrally-formed cup sleeve

DETAILED DESCRIPTION OF THE PREFERRED EMBODIMENTS

A conventional thermal insulation cup sleeve is usually formed in parallel or formed with a ring shape having larger caliber at the top and smaller caliber at the bottom, for being sleeved with a cup-shaped or bottle-shaped or can-shaped container; because the inner caliber of the cup sleeve has to be larger than the diameter of the cup-shaped or bottle-shaped or can-shaped container for being sleeved in, the cup sleep may be more likely to slip or fall after being sleeved with the cup-shaped or bottle-shaped or can-shaped container; if a cup sleeve made of a paper material is used to be directly in contact with the cup-shaped or bottle-shaped or can-shaped container, the provided thermal insulation effect is relatively reduced; if a cup sleeve made of a corrugated board having tubular hole layers is adopted, the thermal insulation effect is increased but still has a disadvantage of being likely to slip and fall.

The present invention provides a cup sleeve formed with a reverse damping structure having one or more rings inwardly bent and annularly arranged on one or both of the edge and the inner periphery of the cup sleeve, so when the mentioned cup sleeve is sleeved with a cup-shaped or bottle-shaped or can-shaped container, the anti-slip damping for enhancing the anti-loose function is provided by the reverse damping structure, thus the cup sleeve is less likely to be released from the cup-shaped or bottle-shaped or can-shaped container, and with the reverse damping structure, the interval formed between the cup sleeve and the cup-shaped or bottle-shaped or can-shaped container is enlarged thereby increasing the thermal insulation effect;

the mentioned reverse damping structure includes at least one or both of the edge and the interior of the cup sleeve being formed with one or more than one of a wrinkling damping structure or tooth damping structure or wavelike damping structure or trapezoid damping structure, which are formed with one or more rings annularly-arranged and downwardly and reversely bent relative to the sleeve-in direction.

According to the present invention, the container (100) is defined as a tubular container formed in a circular or substantially circular or polygonal shape, which includes a cup-shaped or bottle-shaped or can-shaped container formed in parallel or non parallel or in a conical structure, one side thereof is formed as a seal side (102) having the same dimension and in parallel with an open side; the other side thereof is formed as an open side or an openable side having the same dimension and in parallel with the seal side or having a smaller outer diameter or a larger outer diameter; formed as a cup-shaped or bottle-shaped or can-shaped container having the structure with smaller outer diameter or larger outer diameter for accommodating fluid, powders, particles or gels.

Figure 2:
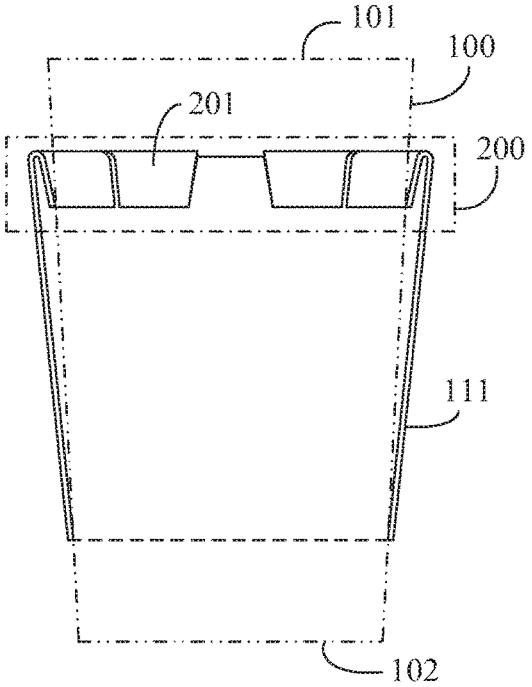
FIG. 2 is a schematic cross sectional view illustrating a cup-shaped container having an upward-facing open side being combined with the cup sleeve with reverse damping structure (111) shown in FIG. 1.

FIG. 1 is a schematic expanded view showing the edge inward bending sheet (201) being adopted for composing the reverse damping system (200) of the cup sleeve with reverse damping structure (111), according to the present invention;

FIG. 2 is a schematic cross sectional view illustrating a cup-shaped container having an upward-facing open side being combined with the cup sleeve with reverse damping structure (111) shown in FIG. 1;

As shown in FIG. 1 and FIG. 2, it mainly consists of:

cup sleeve with reverse damping structure (111): made of a thermal insulation material such as paper, plastic, acrylic or PET; formed as a parallel tubular structure having the geometric shape and the dimension mated with that of s cup-shaped or bottle-shaped or can-shaped container (100), or formed as a conical tubular structure having a larger caliber at the top and a smaller caliber at the bottom; one or both of the edge and the cup sleeve interior is formed with a reverse damping structure (200) having one or more rings inwardly bent and annularly arranged;

The mentioned reverse damping structure (200) includes at least one or both of the edge and the interior of the cup sleeve being formed with one or more than one of an edge inward bending sheet (201), or an edge inward wrinkling member (202) or an edge inward bending wavelike tooth sheet (203) or an edge inward bending trapezoid sheet (204), which are formed with one or more rings annularly-arranged and downwardly and reversely bent relative to the sleeve-in direction;

When the mentioned cup sleeve with reverse damping structure (111) is sleeved with the cup-shaped or bottle-shaped or can-shaped container, the anti-slip damping for providing the anti-loose function is provided by the reverse damping structure (200), thus the cup sleeve is less likely to be released from the cup-shaped or bottle-shaped or can-shaped container, and with the reverse damping structure, the gap formed between the cup sleeve and the cup-shaped or bottle-shaped or can-shaped container is enlarged thereby increasing the thermal insulation effect.

The mentioned cup sleeve with reverse damping structure (111) is used for being sleeved with the cup-shaped or bottle-shaped or can-shaped container (100), as shown in FIG. 2, which is a schematic cross sectional view illustrating a cup-shaped container having an upward-facing open side being combined with the cup sleeve with reverse damping structure (111).

Figure 3:
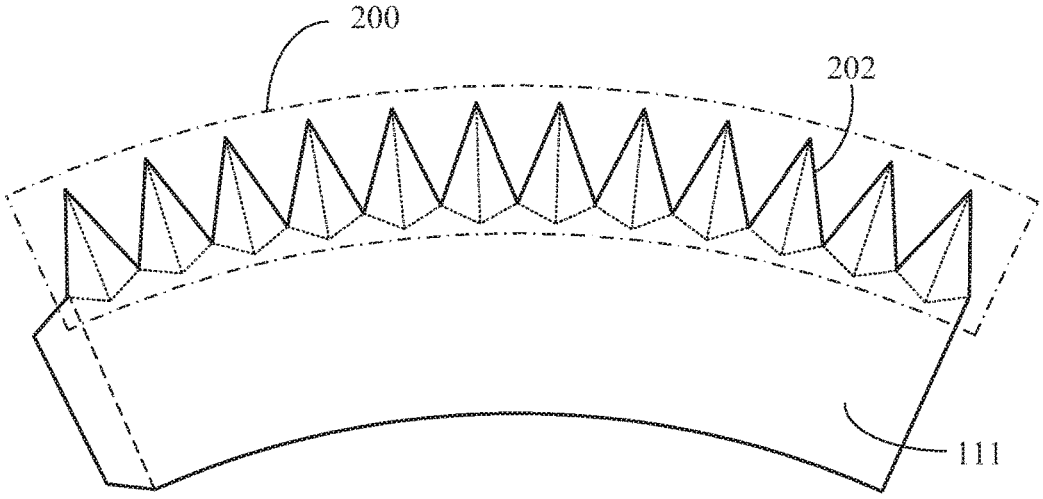
FIG. 3 is a schematic expanded view of the reverse damping structure (200) of the embodiment that the edge inward wrinkling member (202) being adopted for forming the cup sleeve with reverse damping structure (111), according to the present invention.
Figure 4:
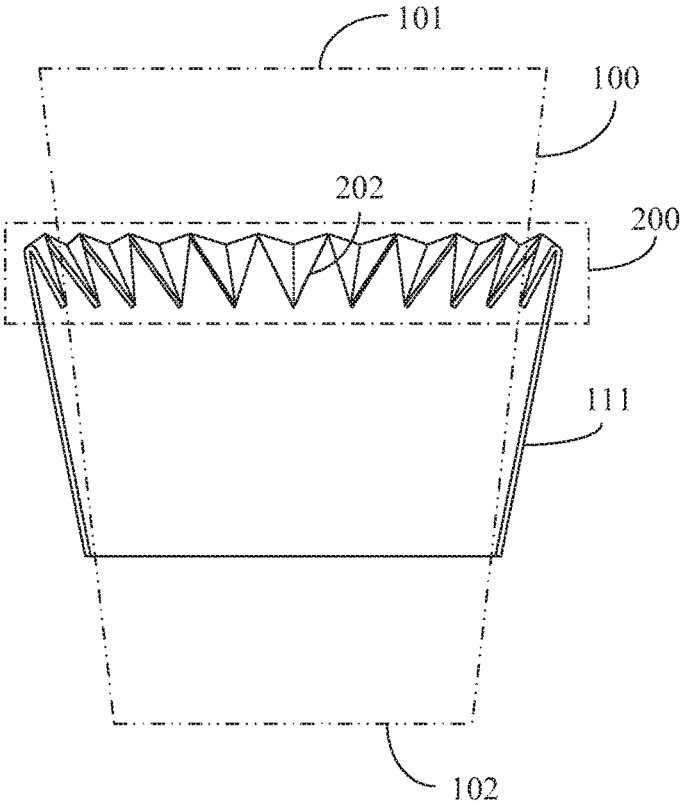
FIG. 4 is a schematic cross sectional view illustrating the cup-shaped container having an upward-facing open side being combined with the cup sleeve with reverse damping structure (111) shown in FIG. 3.

The structural embodiments for illustrating various reverse damping structures (200) of the cup sleeve with reverse damping structure (111) are provided as followings:

FIG. 3 is a schematic expanded view of the reverse damping structure (200) of the embodiment that the edge inward wrinkling member (202) being adopted for forming the cup sleeve with reverse damping structure (111), according to the present invention;

FIG. 4 is a schematic cross sectional view illustrating the cup-shaped container having an upward-facing open side being combined with the cup sleeve with reverse damping structure (111) shown in FIG. 3;

As shown in FIG. 3 and FIG. 4, the main structure thereof is that the cup sleeve with reverse damping structure (111) itself is used for integrally forming the cup sleeve with reverse damping structure (111) and the edge inward bending sheet (201) which is inwardly bent for forming one or more rings annularly arranged; or additionally adopting a material having friction force for forming the edge inward bending sheet (201) which is inwardly bent for forming one or more rings annularly arranged and being adhered, riveted, sewed, or latched or engaged on at least one or both of the edge and the interior of the cup sleeve with reverse damping structure (111), thereby providing anti-slip damping after being sleeved with the cup-shaped or bottle-shaped or can-shaped container (100) and providing the thermal insulation space.

Figure 5:
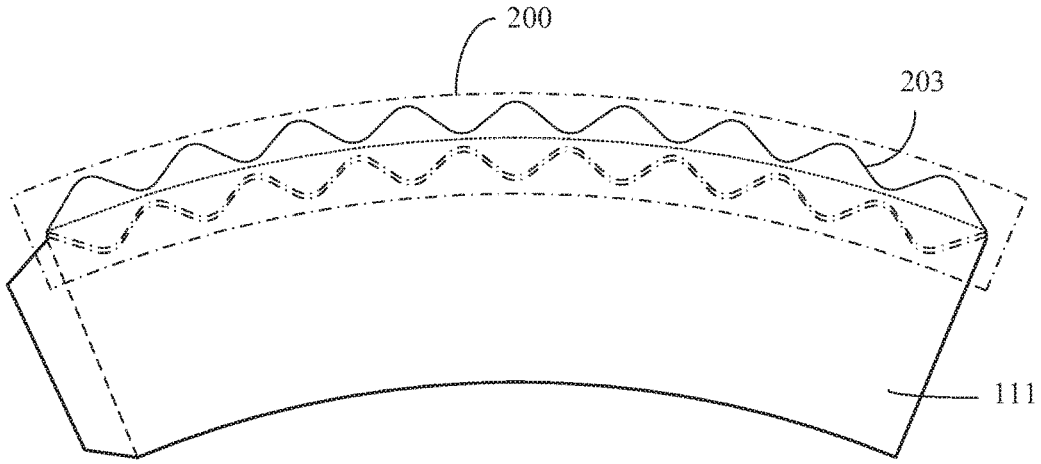
FIG. 5 is a schematic expanded view of the reverse damping structure (200) of the embodiment that the edge inward bending wavelike tooth sheet (203) being adopted for forming the cup sleeve with reverse damping structure (111), according to the present invention.
Figure 6:
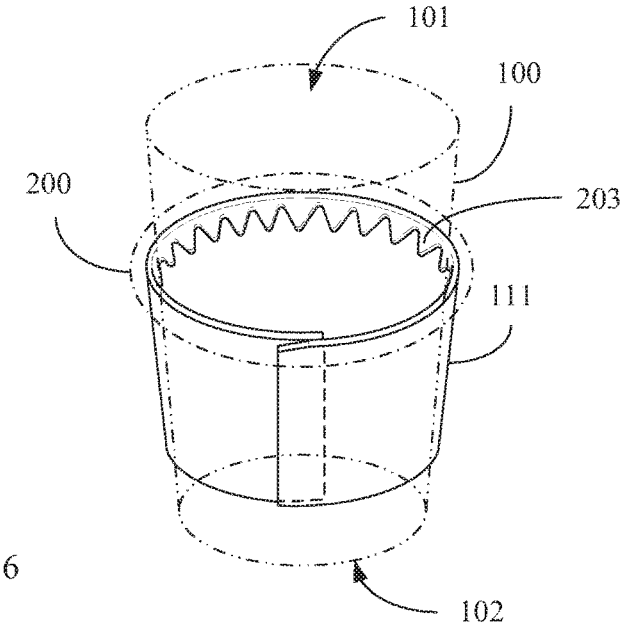
FIG. 6 is a schematic view illustrating the cup-shaped container having an upward-facing open side being combined with the cup sleeve with reverse damping structure (111) shown in FIG. 5.

FIG. 5 is a schematic expanded view of the reverse damping structure (200) of the embodiment that the edge inward bending wavelike tooth sheet (203) being adopted for forming the cup sleeve with reverse damping structure (111), according to the present invention;

FIG. 6 is a schematic view illustrating the cup-shaped container having an upward-facing open side being combined with the cup sleeve with reverse damping structure (111) shown in FIG. 5;

As shown in FIG. 5 and FIG. 6, the main structure thereof is that the cup sleeve with reverse damping structure (111) itself is used for integrally forming the edge inward wrinkling member (202) which is inwardly bent for forming one or more rings annularly arranged; or additionally adopting a material having friction force for forming the edge inward wrinkling member (202) which is inwardly bent for forming one or more rings annularly arranged and being adhered, riveted, sewed, or latched or engaged on at least one or both of the edge and the interior of the cup sleeve with reverse damping structure (111), thereby providing anti-slip damping after being sleeved with the cup-shaped or bottle-shaped or can-shaped container (100) and providing the thermal insulation space.

Figure 7:
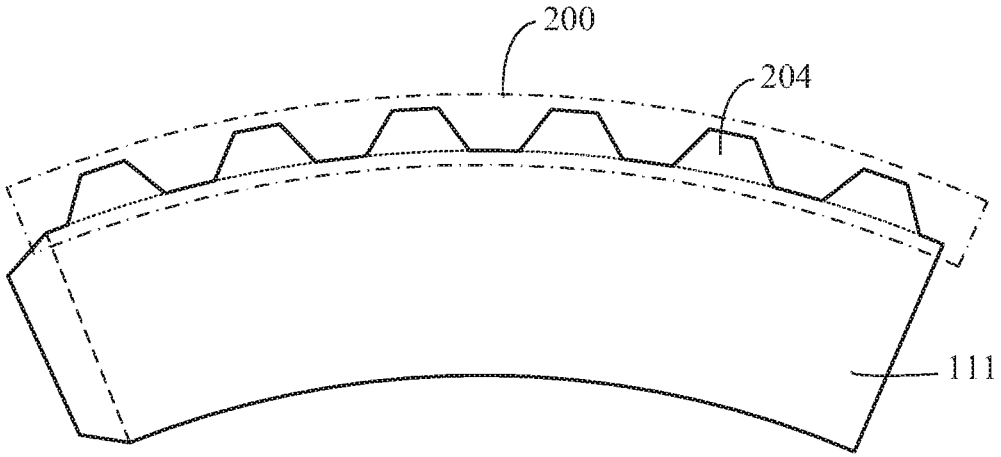
FIG. 7 is a schematic expanded view of the reverse damping structure (200) of the embodiment that the edge inward bending trapezoid sheet (204) being adopted for forming the cup sleeve with reverse damping structure (111), according to the present invention.
Figure 8:
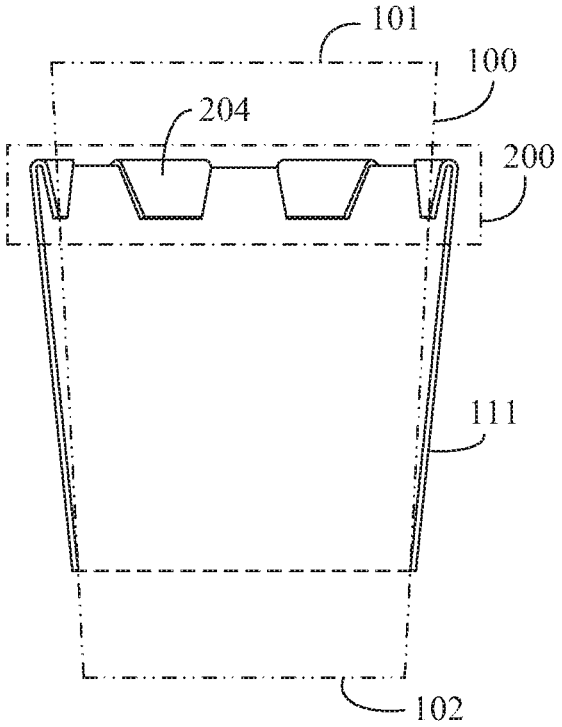
FIG. 8 is a schematic cross sectional view illustrating the cup-shaped container having an upward-facing open side being combined with the cup sleeve with reverse damping structure (111) shown in FIG. 7.

FIG. 7 is a schematic expanded view of the reverse damping structure (200) of the embodiment that the edge inward bending trapezoid sheet (204) being adopted for forming the cup sleeve with reverse damping structure (111), according to the present invention;

FIG. 8 is a schematic cross sectional view illustrating the cup-shaped container having an upward-facing open side being combined with the cup sleeve with reverse damping structure (111) shown in FIG. 7;

As shown in FIG. 7 and FIG. 8, the main structure thereof is that the cup sleeve with reverse damping structure (111) itself is used for integrally forming the edge inward bending trapezoid sheet (204) which is inwardly bent and annularly arranged; or additionally adopting a material having friction force for forming the edge inward bending trapezoid sheet (204) which is inwardly bent for forming one ring annularly arranged and being adhered, riveted, sewed, or latched or engaged on the edge of the cup sleeve with reverse damping structure (111), thereby providing anti-slip damping after being sleeved with the cup-shaped or bottle-shaped or can-shaped container (100) and providing the thermal insulation space.

Figure 9:
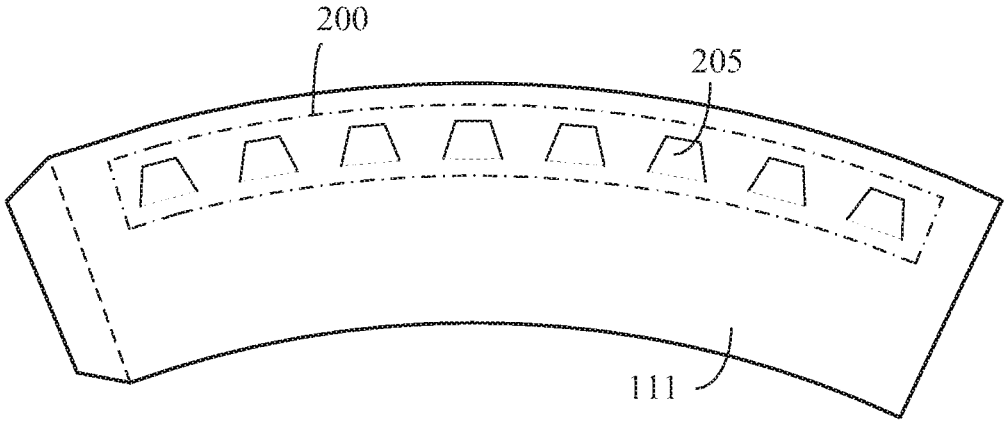
FIG. 9 is a schematic expanded view of the reverse damping structure (200) of the embodiment that the inner periphery inward bending sheet (205) being annularly provided at the periphery of the cup sleeve for forming the cup sleeve with reverse damping structure (111), according to the present invention.
Figure 10:
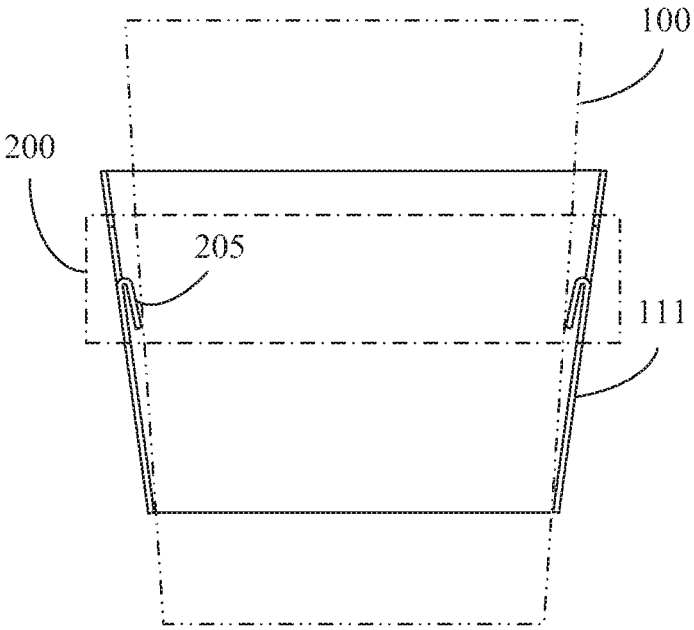
FIG. 10 is a schematic cross sectional view illustrating the cup-shaped container having an upward-facing open side being combined with the cup sleeve with reverse damping structure (111) shown in FIG. 9.
Figure 21:
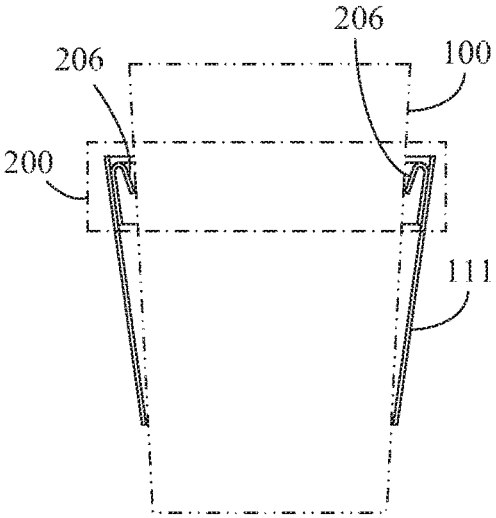
FIG. 21 is a schematic view illustrating the interior of the cup sleeve of the cup sleeve with reverse damping structure (111) being additionally combined with an individual circular structure having inward bending sheet (206) in one ring thereby forming the enclosed and annular reverse damping structure (200), according to the present invention.

The cup sleeve with reverse damping structure (111) is further provided with an inner periphery inward bending sheet (205) at the inner periphery of the cup sleeve for forming the reverse damping structure (200) of the cup sleeve with reverse damping structure (111);

FIG. 9 is a schematic expanded view of the reverse damping structure (200) of the embodiment that the inner periphery inward bending sheet (205) being annularly provided at the periphery of the cup sleeve for forming the cup sleeve with reverse damping structure (111), according to the present invention;

FIG. 10 is a schematic cross sectional view illustrating the cup-shaped container having an upward-facing open side being combined with the cup sleeve with reverse damping structure (111) shown in FIG. 9;

As shown in FIG. 9 and FIG. 10, the main structure thereof is that the periphery of the cup sleeve with reverse damping structure (111) itself is used for integrally forming the inner periphery inward bending sheet (205) which is annularly arranged in one ring; or additionally adopting a material having friction force for forming an inwardly-bent individual circular structure having inward bending sheet (206) (as shown in FIG. 21) which is annularly adhered, riveted, sewed, or latched or engaged in one ring in the inner periphery of the cup sleeve with reverse damping structure (111), thereby providing anti-slip damping after being sleeved with the cup-shaped or bottle-shaped or can-shaped container (100) and providing the thermal insulation space;

The mentioned edge inward bending sheet (201) or the individual circular structure having inward bending sheet (206) includes being formed by wavelike tooth bending sheets or trapezoid bending sheets;

Each inner periphery inward bending sheet (205) or the individual circular structure having inward bending sheet (206) arranged at the same ring can have the same or different shapes.

Figure 11:
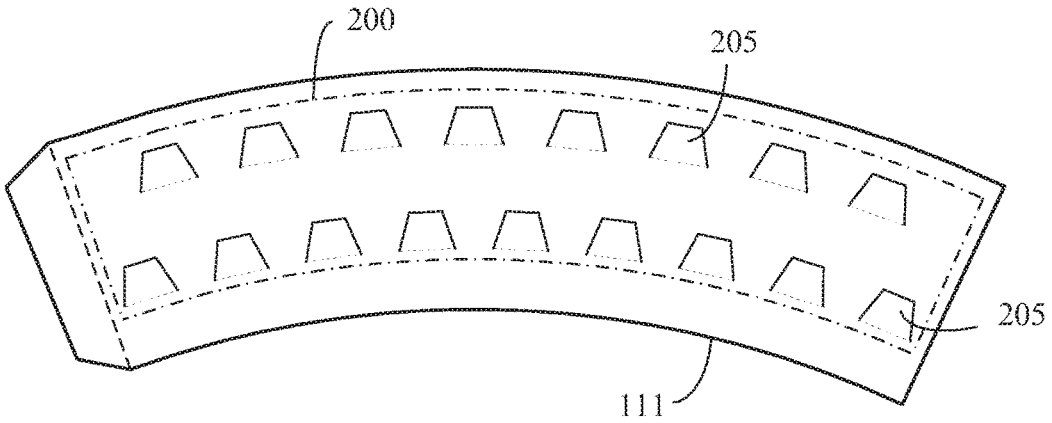
FIG. 11 is a schematic expanded view illustrating the embodiment that the inner periphery inward bending sheet (205) formed with two or more rings staggeringly arranged at the periphery of the cup sleeve for forming the multi-rings annularly arranged reverse damping structure (200) of the cup sleeve with reverse damping structure (111), according to the present invention.
Figure 12:
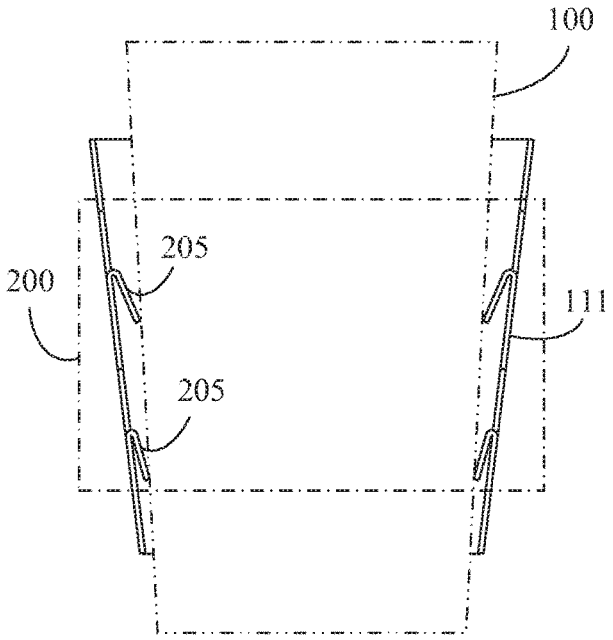
FIG. 12 is a schematic cross sectional view illustrating the cup-shaped container having an upward-facing open side being combined with the cup sleeve with reverse damping structure (111) shown in FIG. 11.
Figure 22:
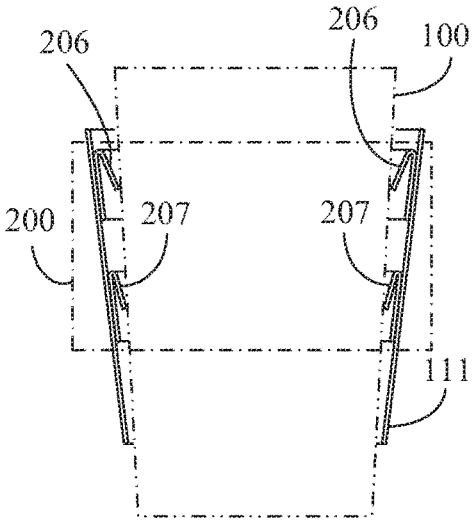
FIG. 22 is a schematic view illustrating the interior of the cup sleeve of the cup sleeve with reverse damping structure (111) being additionally combined with the enclosed annular reverse damping structure (200) having the individual circular structure having inward bending sheet (206), and at least an enclosed annular reverse damping structure (200) having the individual circular structure having inward bending sheet (207), according to the present invention.

FIG. 11 is a schematic expanded view illustrating the embodiment that the inner periphery inward bending sheet (205) formed with two or more rings staggeringly arranged at the periphery of the cup sleeve for forming the multi-rings annularly arranged reverse damping structure (200) of the cup sleeve with reverse damping structure (111), according to the present invention;

FIG. 12 is a schematic cross sectional view illustrating the cup-shaped container having an upward-facing open side being combined with the cup sleeve with reverse damping structure (111) shown in FIG. 11;

As shown in FIG. 11 and FIG. 12, the main structure thereof is that the periphery of the cup sleeve with reverse damping structure (111) itself is used for integrally forming the inner periphery inward bending sheet (205) formed with two or more rings staggeringly arranged; or additionally adopting a material having friction force for forming an inwardly-bent individual circular structure having inward bending sheet (206, 207) (as shown in FIG. 22) formed with two or more rings staggeringly arranged for being annularly adhered, riveted, sewed, or latched or engaged in the inner periphery of the cup sleeve with reverse damping structure (111), thereby providing anti-slip damping after being sleeved with the cup-shaped or bottle-shaped or can-shaped container (100) and providing the thermal insulation space;

The mentioned edge inward bending sheet (201) includes being formed by wavelike tooth bending sheets or trapezoid bending sheets;

Each inner periphery inward bending sheet (205) or the individual circular structure having inward bending sheet (206, 207) arranged at the same or different rings can have the same or different shapes;

The mentioned inner periphery inward bending sheet (205) or the individual circular structure having inward bending sheet (206, 207) arranged at different rings can have the same or different quantity.

Figure 13:
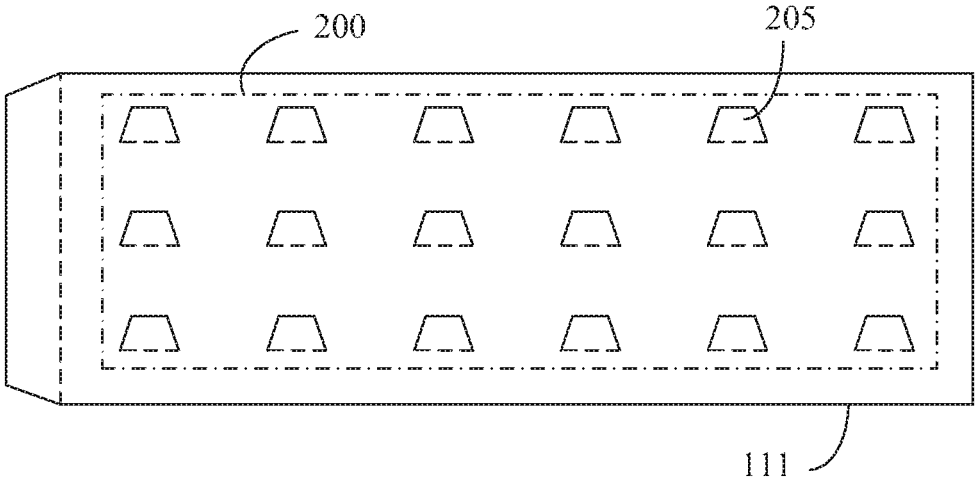
FIG. 13 is a schematic expanded view illustrating the embodiment that the inner periphery inward bending sheet (205) formed with two or more rings inwardly bent and arranged with an array format at the periphery of the cup sleeve for forming the multi-rings annularly arranged reverse damping structure (200) of the cup sleeve with reverse damping structure (111), according to the present invention.
Figure 14:
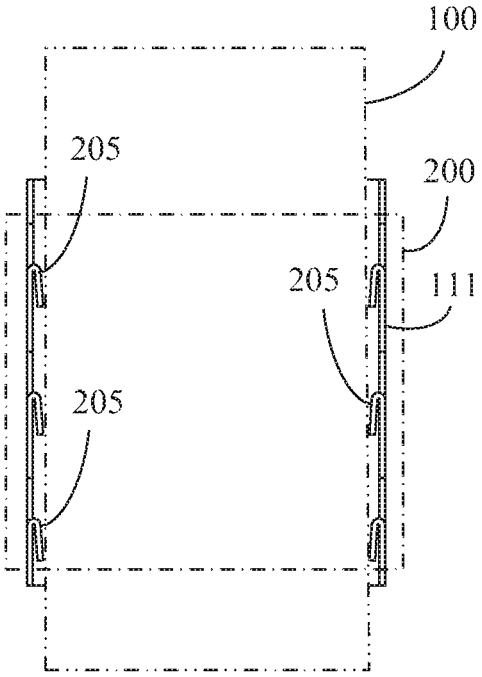
FIG. 14 is a schematic cross sectional view illustrating the tubular container being combined with the sheet-shaped enclose type cup sleeve with the edge formed with reverse damping structure shown in FIG. 13.

FIG. 13 is a schematic expanded view illustrating the embodiment that the inner periphery inward bending sheet (205) formed with two or more rings inwardly bent and arranged with an array format at the periphery of the cup sleeve for forming the multi-rings annularly arranged reverse damping structure (200) of the cup sleeve with reverse damping structure (111), according to the present invention;

FIG. 14 is a schematic cross sectional view illustrating the tubular container being combined with the sheet-shaped enclose type cup sleeve with the edge formed with reverse damping structure shown in FIG. 13;

As shown in FIG. 13 and FIG. 14, the main structure thereof is that the periphery of the cup sleeve with reverse damping structure (111) itself is used for integrally forming the inner periphery inward bending sheet (205) formed with two or more rings annularly arranged with an array format; or additionally adopting a material having friction force for forming an inwardly-bent individual circular structure having inward bending sheet (206, 207) (as shown in FIG. 22) formed with two or more rings arranged with an array format for being annularly adhered, riveted, sewed, or latched or engaged in the inner periphery of the cup sleeve with reverse damping structure (111), thereby providing anti-slip damping after being sleeved with the cup-shaped or bottle-shaped or can-shaped container (100) and providing the thermal insulation space;

The mentioned inner periphery inward bending sheet (205) or the individual circular structure having inward bending sheet (206, 207) includes being formed by wavelike tooth bending sheets or trapezoid bending sheets;

Each inner periphery inward bending sheet (205) or the individual circular structure having inward bending sheet (206, 207) arranged at the same or different rings can have the same or different shapes;

The mentioned inner periphery inward bending sheet (205) or the individual circular structure having inward bending sheet (206, 207) arranged at different rings can have the same or different quantity.

Figure 15:
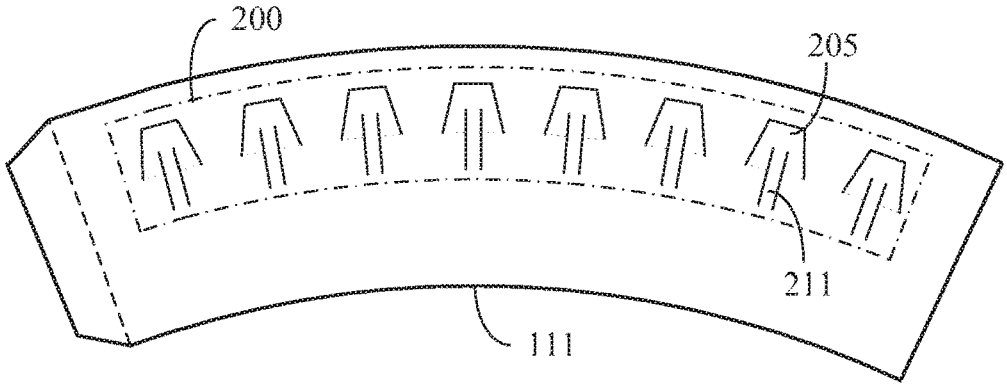
FIG. 15 is a schematic expanded view showing the inner periphery inward bending sheet (205) arranged at the periphery of the cup sleeve as shown in FIG. 9 being further installed with an inward-bending pre-force arm (211).
Figure 16:
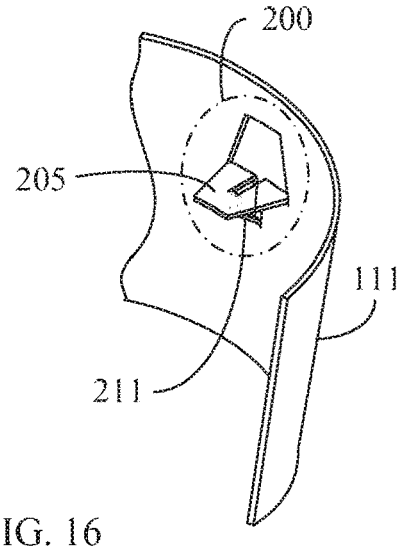
FIG. 16 is a partial cross sectional view showing the three dimensional structure of FIG. 15.

In the reverse damping structure (200) of the anti-loose thermal insulation cup sleeve with reverse damping structure of the present invention, a pre-force arm (211) capable of outwardly bending for driving the reverse damping structure (200) to be inwardly bent can be formed at the center of the root of the connection location of the inner periphery inward bending sheet (205) and the cup sleeve with reverse damping structure (111), thereby generating an inwardly bending pre-force to the inner periphery inward bending sheet (205), and thereby increasing the reverse friction damping provided by inner periphery inward bending sheet (205) to the cup-shaped or bottle-shaped or can-shaped container (100);

FIG. 15 is a schematic expanded view showing the inner periphery inward bending sheet (205) arranged at the periphery of the cup sleeve as shown in FIG. 9 being further installed with an inward-bending pre-force arm (211);

FIG. 16 is a partial cross sectional view showing the three dimensional structure of FIG. 15;

As shown in FIG. 15 and FIG. 16, the main structure thereof is that the periphery of the cup sleeve with reverse damping structure (111) itself is used for integrally forming the inner periphery inward bending sheet (205) which is annularly arranged; or additionally adopting a material having friction force for forming an individual circular structure having inward bending sheet (206) (as shown in FIG. 21) which is annularly adhered, riveted, sewed, or latched or engaged in one ring in the inner periphery of the cup sleeve with reverse damping structure (111), thereby providing anti-slip damping after being sleeved with the cup-shaped or bottle-shaped or can-shaped container (100) and providing the thermal insulation space;

The mentioned inner periphery inward bending sheet (205) or the individual circular structure having inward bending sheet (206) includes being formed by wavelike tooth bending sheets or trapezoid bending sheets;

Each inner periphery inward bending sheet (205) or the individual circular structure having inward bending sheet (206) arranged at the same ring can have the same or different shapes.

Figure 17:
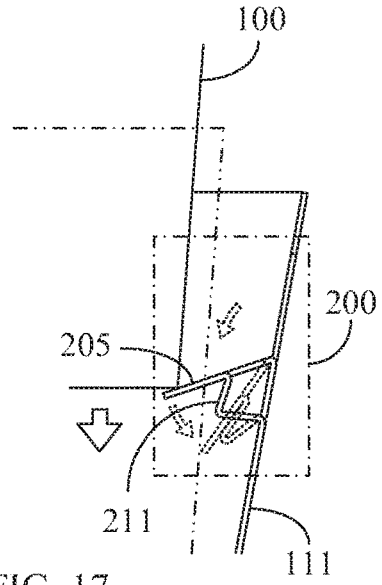
FIG. 17 is a schematic view illustrating the process of FIG. 15 being sleeved with the cup sleeve.
Figure 18:
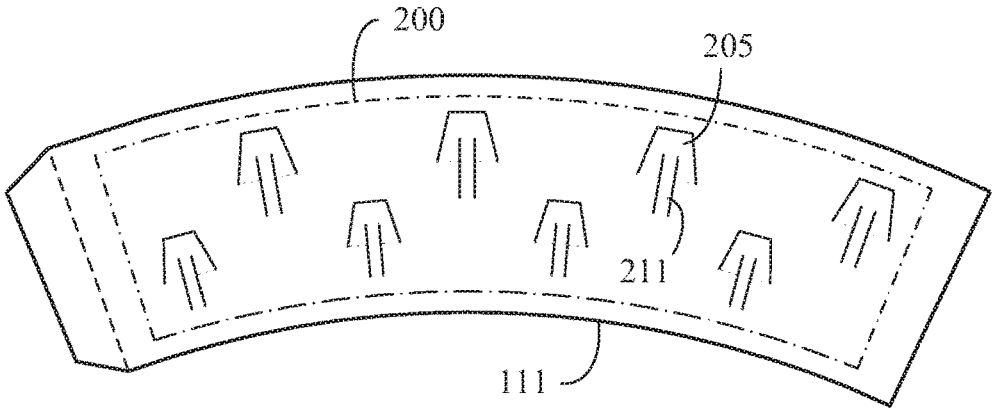
FIG. 18 is a schematic expanded view illustrating the inner periphery inward bending sheet (205) formed with two or more rings staggeringly arranged at the periphery of the cup sleeve being further provided with the inward-bending pre-force arm (211).

FIG. 17 is a schematic view illustrating the process of FIG. 15 being sleeved with the cup sleeve;

FIG. 18 is a schematic expanded view illustrating the inner periphery inward bending sheet (205) formed with two or more rings staggeringly arranged at the periphery of the cup sleeve being further provided with the inward-bending pre-force arm (211);

As shown in FIG. 18, the main structure thereof is that the periphery of the cup sleeve with reverse damping structure (111) itself is used for integrally forming the inner periphery inward bending sheet (205) having two or more rings annularly arranged; or additionally adopting a material having friction force for forming an inwardly-bent individual circular structure having inward bending sheet (206, 207) (as shown in FIG. 22) formed with two or more rings staggeringly arranged for being annularly adhered, riveted, sewed, or latched or engaged in the inner periphery of the cup sleeve with reverse damping structure (111), thereby providing anti-slip damping after being sleeved with the cup-shaped or bottle-shaped or can-shaped container (100) and providing the thermal insulation space;

The mentioned the inner periphery inward bending sheet (205) or the individual circular structure having inward bending sheet (206, 207) includes being formed by wavelike tooth bending sheets or trapezoid bending sheets;

Each inner periphery inward bending sheet (205) or the individual circular structure having inward bending sheet (206, 207) arranged at the same or different rings can have the same or different shapes;

The mentioned inner periphery inward bending sheet (205) or the individual circular structure having inward bending sheet (206, 207) arranged at different rings can have the same or different quantity.

Figure 19:
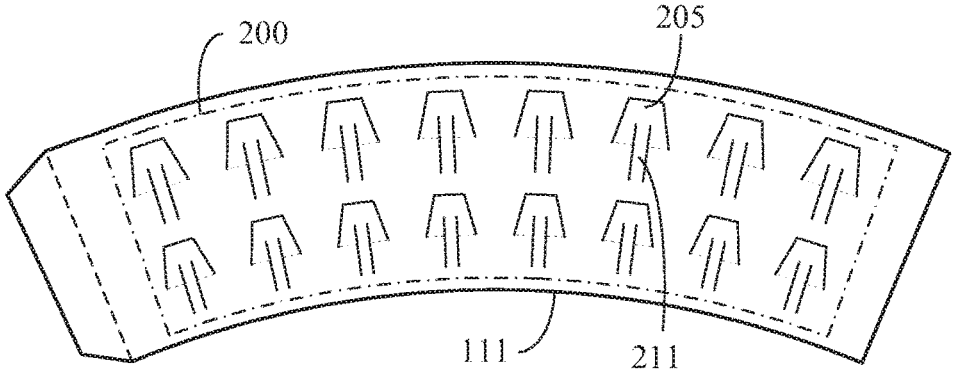
FIG. 19 is a schematic expanded view illustrating the inner periphery inward bending sheet (205) formed with two or more rings annularly arranged with an array format at the periphery of the cup sleeve being further provided with the inward-bending pre-force arm (211).

FIG. 19 is a schematic expanded view illustrating the inner periphery inward bending sheet (205) formed with two or more rings annularly arranged with an array format at the periphery of the cup sleeve being further provided with the inward-bending pre-force arm (211);

As shown in FIG. 19, the main structure thereof is that the periphery of the cup sleeve with reverse damping structure (111) itself is used for integrally forming the inner periphery inward bending sheet (205) having plural rings annularly arranged; or additionally adopting a material having friction force for forming an inwardly-bent individual circular structure having inward bending sheet (206, 207) (as shown in FIG. 22) formed with two or more rings annularly arranged with an array format for being annularly adhered, riveted, sewed, or latched or engaged in the inner periphery of the cup sleeve with reverse damping structure (111), thereby providing anti-slip damping after being sleeved with the cup-shaped or bottle-shaped or can-shaped container (100) and providing the thermal insulation space;

The mentioned the inner periphery inward bending sheet (205) or the individual circular structure having inward bending sheet (206, 207) includes being formed by wavelike tooth bending sheets or trapezoid bending sheets;

Each inner periphery inward bending sheet (205) or the individual circular structure having inward bending sheet (206, 207) arranged at the same or different rings can have the same or different shapes;

The mentioned inner periphery inward bending sheet (205) or the individual circular structure having inward bending sheet (206, 207) arranged at different rings can have the same or different quantity.

Figure 20:
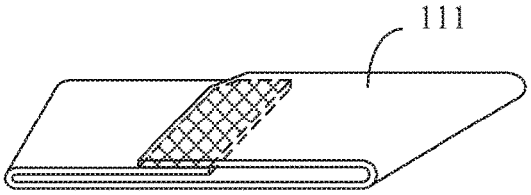
FIG. 20 is a schematic view showing the cup sleeve with reverse damping structure (111) being formed in a laminated state, according to the present invention.

FIG. 20 is a schematic view showing the cup sleeve with reverse damping structure (111) being formed in a laminated state, according to the present invention;

As shown in FIG. 20, two sides of the cup sleeve with reverse damping structure (111) are adhered, riveted or latched for enabling the cup sleeve with reverse damping structure (111) to be formed in a circular shape, and is pressed and bent for forming the laminated state thereby facilitating the lamination and storage, and capable of being stretched and unfolded while being in use.

FIG. 21 is a schematic view illustrating the interior of the cup sleeve of the cup sleeve with reverse damping structure (111) being additionally combined with an individual circular structure having inward bending sheet (206) in one ring thereby forming the enclosed and annular reverse damping structure (200), according to the present invention;

As shown in FIG. 21, the configuration means is that the interior of the cup sleeve is additionally combined with the individual circular structure having inward bending sheet (206), thereby being latched, adhered or riveted in the interior of the cup sleeve of the cup sleeve with reverse damping structure (111).

FIG. 22 is a schematic view illustrating the interior of the cup sleeve of the cup sleeve with reverse damping structure (111) being additionally combined with the enclosed annular reverse damping structure (200) having the individual circular structure having inward bending sheet (206), and at least an enclosed annular reverse damping structure (200) having the individual circular structure having inward bending sheet (207), according to the present invention;

As shown in FIG. 22, the configuration means is that the interior of the cup sleeve is additionally combined with the individual circular structure having inward bending sheet (206), and at least an individual circular structure having inward bending sheet (207), thereby being spaced with an interval, and latched, adhered or riveted in the interior of the cup sleeve of the cup sleeve with reverse damping structure (111).

Figure 23:
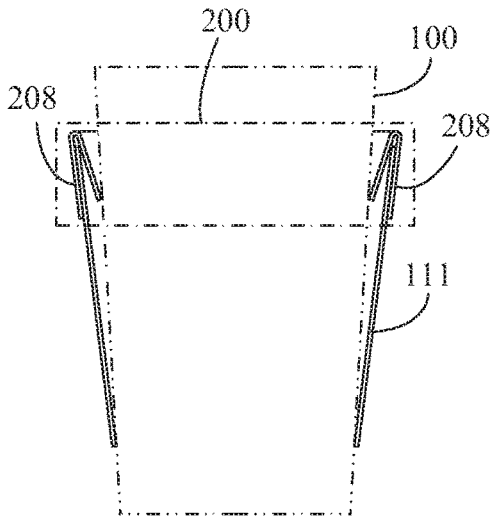
FIG. 23 is a cross sectional view illustrating one side of the edge frame of the cup sleeve with reverse damping structure (111) being combined with an inward bending sheet clamped at the periphery of edge frame (208) thereby forming the reverse damping structure (200), according to the present invention.

FIG. 23 is a cross sectional view illustrating one side of the edge frame of the cup sleeve with reverse damping structure (111) being combined with an inward bending sheet clamped at the periphery of edge frame (208) thereby forming the reverse damping structure (200), according to the present invention;

As shown in FIG. 23, it mainly consists of:

The inward bending sheet clamped at the periphery of edge frame (208) having a ∩-shaped cross section is installed on an edge frame at one side of the cup sleeve with reverse damping structure (111), the outer periphery thereof is latched, adhered or riveted on the edge frame of the cup sleeve with reverse damping structure (111), the inner periphery thereof is provided with the inward bending sheet clamped at the periphery of edge frame (208), thereby forming the reverse damping structure (200) for generating reverse damping.

Figure 24:
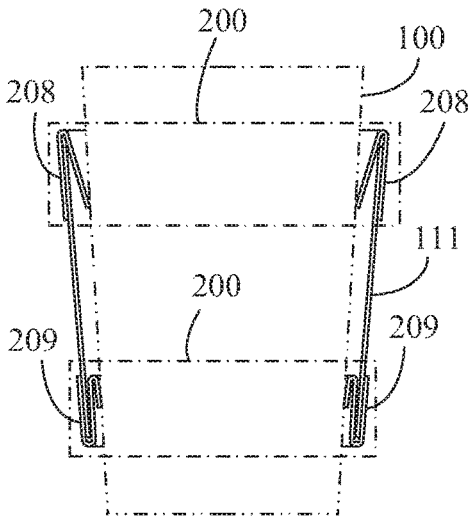
FIG. 24 is a cross sectional view illustrating two sides of the edge frame of the cup sleeve with reverse damping structure (111) being combined with the inward bending sheet clamped at the periphery of edge frame (208, 209), thereby forming the reverse damping structure (200), according to the present invention.

FIG. 24 is a cross sectional view illustrating two sides of the edge frame of the cup sleeve with reverse damping structure (111) being combined with the inward bending sheet clamped at the periphery of edge frame (208, 209), thereby forming the reverse damping structure (200), according to the present invention;

As shown in FIG. 24, it mainly consists of:

The inward bending sheet clamped at the periphery of edge frame (208) having a ∩-shaped cross section is installed on an edge frame at one side of the cup sleeve with reverse damping structure (111), the outer periphery thereof is latched, adhered or riveted on the edge frame of the cup sleeve with reverse damping structure (111), the inner periphery thereof is provided with the inner periphery inward bending sheet (205) for generating reverse damping;

the other inward bending sheet clamped at the periphery of edge frame (209) having a ∩-shaped cross section is installed on the edge frame at another side of the cup sleeve with reverse damping structure (111), the outer periphery thereof is latched, adhered or riveted on the edge frame of the cup sleeve with reverse damping structure (111), the inward bending sheet clamped at the periphery of edge frame (209) provided at the inner periphery is formed as the repeated bending in which firstly bent inwardly then bent outwardly, thereby the inward bending sheet clamped at the periphery of edge frame (208, 209) at two sides forming the reverse damping structure (200), and the direction in which the reverse damping being generated is the same.

Figure 25:
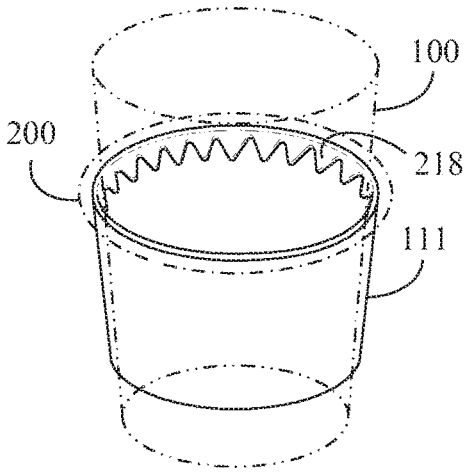
FIG. 25 is a schematic view showing the cup sleeve with reverse damping structure (111), and the reverse damping structure (200) composed of an edge inward bending sheet of integrally-formed cup sleeve (218) at one side thereof being formed as an integral structure.

FIG. 25 is a schematic view showing the cup sleeve with reverse damping structure (111), and the reverse damping structure (200) composed of an edge inward bending sheet of integrally-formed cup sleeve (218) at one side thereof being formed as an integral structure;

As shown in FIG. 25, the main configuration is that the sleeve cup with reverse damping structure (111), and the reverse damping structure (200) composed of the edge inward bending sheet of integrally-formed cup sleeve (218) at one side thereof are integrally formed.

Figure 26:
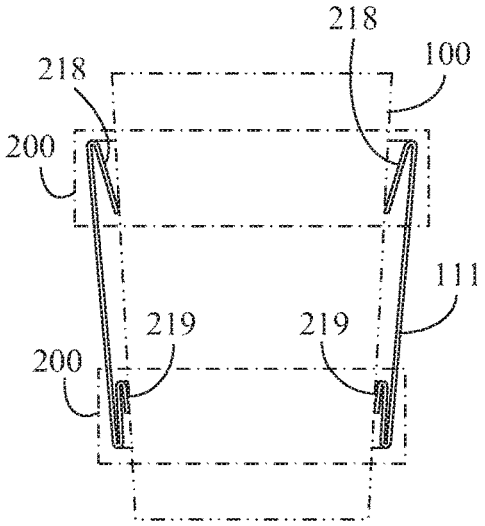
FIG. 26 is a cross sectional view showing the cup sleeve with reverse damping structure (111), and the reverse damping structures (200) composed of edge inward bending sheets of integrally-formed cup sleeve (218, 219) at two sides thereof being formed as an integral structure.

FIG. 26 is a cross sectional view showing the cup sleeve with reverse damping structure (111), and the reverse damping structures (200) composed of edge inward bending sheets of integrally-formed cup sleeve (218, 219) at two sides thereof being formed as an integral structure;

As shown in FIG. 26, the main configuration is that the sleeve cup with reverse damping structure (111), and the reverse damping structures (200) composed of the edge inward bending sheets of integrally-formed cup sleeve (218, 219) at two sides thereof are integrally formed with the same material; wherein the edge inward bending sheets of integrally-formed cup sleeve (218) at one side is inwardly bent from the edge thereby forming an elastic angle; the edge inward bending sheets of integrally-formed cup sleeve (219) at the other side is formed as the repeated bending in which firstly bent inwardly then bent outwardly, thereby the edge inward bending sheets of integrally-formed cup sleeve (218, 219) at two sides forming the reverse damping structure (200), and the direction in which the reverse damping being generated is the same.

The disclosed structural embodiments of the reverse damping structure (200) are used for illustrating one feature of being forwardly sleeved in the cup-shaped or bottle-shaped or can-shaped container (100), and providing partial structural geometric shapes to illustrate the reverse friction damping effect being enhanced after sleeve in, the mentioned feature and geometric shapes disclosed above shall not be the limitation of the present invention, the feature and structural geometric shape providing the same functions which adopts the technical characteristics of the present invention shall be within the scope of the present invention.

The invention claimed is:

1. An anti-loosening thermal insulation cup sleeve (111), comprising:

first and second reverse damping structures (200) arranged on an inner periphery of the cup sleeve (111), said thermal insulation cup sleeve being secured to a container (100) by said first and second reverse damping structures (200), wherein the first and second reverse damping structures (200) extend annularly around an inner periphery of the cup sleeve (111) and engage an outer periphery of the container (100) to resist release of the cup sleeve (111) from the container (100) while maintaining a predetermined spacing of the cup sleeve from the container to increase a thermal insulation effect of the cup sleeve, wherein the first reverse damping structure (200) includes a plurality of first container-engaging structures that extend downwardly and inwardly from an upper edge of the cup sleeve (111), and wherein the second reverse damping structure (200) includes a plurality of second container-engaging structures, each having an upwardly-bent section that extends upwardly and inwardly from a lower edge of the cup sleeve (111), a U-shaped section that extends from the upwardly-bent section, and a downwardly-bent section that extends downwardly and inwardly from the U-shaped section to engage the outer periphery of the container (100).

2. An anti-loosening thermal insulation cup sleeve as claimed in claim 1, wherein said first edge of the cup sleeve (111) has a wave shape to form downwardly bent sheet members (218).

3. An anti-loosening thermal insulation cup sleeve as claimed in claim 1, wherein the cup sleeve (111) is made of at least one thermally-insulating material selected from the group consisting of paper, plastic, acrylic, and polyethylene teraphthalate (PET).

4. An anti-loosening thermal insulation cup sleeve as claimed in claim 1, wherein the cup sleeve (111) is formed into one of a tubular and a frustoconical shape.

5. An anti-loosening thermal insulation cup sleeve as claimed in claim 1, wherein the cup sleeve (111) is formed into a frustoconical shape and a first end of the conical shape having a smaller diameter than a second end of the conical shape forms a bottom end of the cup sleeve (111).

6. An anti-loosening thermal insulation cup sleeve as claimed in claim 1, wherein the container (100) is one of a cup, a bottle, and a can.

7. An anti-loosening thermal insulation cup sleeve (111), comprising:

first container-engaging structures formed by individual downwardly bent sheet members (218) that are cut-out of a first edge of the cup sleeve (111) and have distal ends that engage the outer periphery of the container (100), and second container-engaging structures formed by individual container-engaging structures (219) that are cut-out of the second edge of the cup sleeve (111) and have an upwardly facing U-shaped cross-section and a downwardly facing U-shaped cross-section.

8. An anti-loosening thermal insulation cup sleeve as claimed in claim 7, wherein said first edge of the cup sleeve (111) has a wave shape to form said downwardly bent sheet members (218).

9. An anti-loosening thermal insulation cup sleeve as claimed in claim 7, wherein the cup sleeve (111) is made of at least one thermally-insulating material selected from the group consisting of paper, plastic, acrylic, and polyethylene teraphthalate (PET).

10. An anti-loosening thermal insulation cup sleeve as claimed in claim 7, wherein the cup sleeve (111) is formed into one of a tubular and a frustoconical shape.

11. An anti-loosening thermal insulation cup sleeve as claimed in claim 7, wherein the cup sleeve (111) is formed into a frustoconical shape and a first end of the conical shape having a smaller diameter than a second end of the conical shape forms a bottom end of the cup sleeve (111).

12. An anti-loosening thermal insulation cup sleeve as claimed in claim 7, wherein the container (100) is one of a cup, a bottle, and a can.

* * * * *